United States Patent [19]

Gaudet

[11] 4,401,034

[45] Aug. 30, 1983

[54] AERIAL CABLEWAY HAVING A RETURN SHEAVE WITH A SPEED STABILIZATION DEVICE

[75] Inventor: Henri Gaudet, Bourg-la-Reine, France

[73] Assignee: Cie Miniere de l'Ogooue (COMILOG), Neuilly sur Seine, France

[21] Appl. No.: 119,942

[22] Filed: Feb. 8, 1980

[30] Foreign Application Priority Data

Feb. 27, 1979 [FR] France ..... 79 05909

[51] Int. Cl.[3] ..... B61B 7/04; B61B 11/00

[52] U.S. Cl. ..... 104/178; 104/180; 198/810; 318/69; 318/77

[58] Field of Search ..... 104/112, 113, 117, 173 R, 104/173 ST, 178–180, 196; 318/69, 77; 198/810, 855

[56] References Cited

U.S. PATENT DOCUMENTS

| | | | |
|---|---|---|---|
| 2,418,104 | 3/1947 | Widen et al. | 104/178 X |
| 2,625,257 | 1/1953 | Schenk | 198/855 |
| 2,782,902 | 2/1957 | Sloane | 198/810 |
| 2,883,036 | 4/1959 | Fox et al. | 318/77 X |
| 3,071,083 | 1/1963 | Hochmuth | 104/178 |
| 3,221,667 | 12/1965 | Watt | 104/178 X |
| 3,989,989 | 11/1976 | Mayer | 198/855 |
| 4,032,003 | 6/1977 | Hull | 198/855 |
| 4,051,415 | 9/1977 | Martin | 318/77 X |

*Primary Examiner*—Randolph A. Reese

*Attorney, Agent, or Firm*—Stevens, Davis, Miller & Mosher

[57] ABSTRACT

The subject of this invention is an aerial cableway having a towing cable which is continually driven by a drive motor located in one station. In another station, the cable passes over a return sheave which is mechanically coupled to an electric speed stabilization device which drives or brakes the rotation of the return sheave so as to maintain a speed set value corresponding to the motor drive speed.

2 Claims, 2 Drawing Figures

AERIAL CABLEWAY HAVING A RETURN SHEAVE WITH A SPEED STABILIZATION DEVICE

The invention relates to an aerial cableway having a towing cable which is moved continually in an endless path between a starting station and an arrival station. Load carriers are connected to the towing cable and at the arrival station run onto transfer rails for transferring the carriers to an other conveyer section or to the return strand of the cable.

When the speed of the conventional cableways exceeds a certain value, for instance 2.5 m/sec, there is a danger of cable oscillations which may provoke derailment of the cable, slipping of the load connected by friction to the cable, and wear of the cable supporting rollers. Further when the cableway comprises several successive sections, the velocity of a load carrier leaving the cable is the same as the instantaneous velocity of the cable at the deconnecting point which is modified by the cable oscillations. The time required to pass from one section to the other by running on the transfer rail varies, and these fluctuations modify the regular staggering of the carriers given at the loading station.

An object of the present invention is to provide an aerial cableway which can be safely worked at high speed and/or may comprise many successive sections, the load carriers being regularly spaced along the cables.

According to a feature of the invention, the return sheave of the cableway is mechanically coupled to an electrical rotating machine to stabilize the speed of this sheave. A speed control device compares a speed signal given by a tachogenerator driven by the return sheave to a set speed value and changes the working characteristic of the rotating machine to brake or to drive the return sheave. It is clear that the set speed value corresponds to the cableway drive motor speed so that the cable speed at the starting and at the arrival station is equal. The load carriers or vehicles leaving the cable at the arrival station each runs with the same velocity.

The stabilization device in accordance with the invention has been successfully applied to a conventional conveyer to increase its transport capacity.

At starting and stopping of the conveyer the set value is manually or automatically changed to always correspond to the drive motor speed.

It is advantageous for the electric rotating machine to be a direct current machine with power supplied by means of a thyristor bridge so as to work selectively as a motor or as a generator to respectively drive or brake the return sheave. Such rotating machines are well known and may be of the type described in German Pat. No. 1,234,834.

The stabilization device may be used for conveyers having many successive sections so as to provide a total length of more then ten kilometers, but it is clear that the stabilization of the return sheave permits a limitation of the cable oscillations of any kind of cableway with one or two cables used for passengers or material transport. The drive motor may be located at the starting station with the return sheave with the stabilization device located at the arrival station, or the location may be reversed.

Other objects and advantages of the invention will at apparent from the following description with reference to the accompanying drawing wherein.

Figure 1:
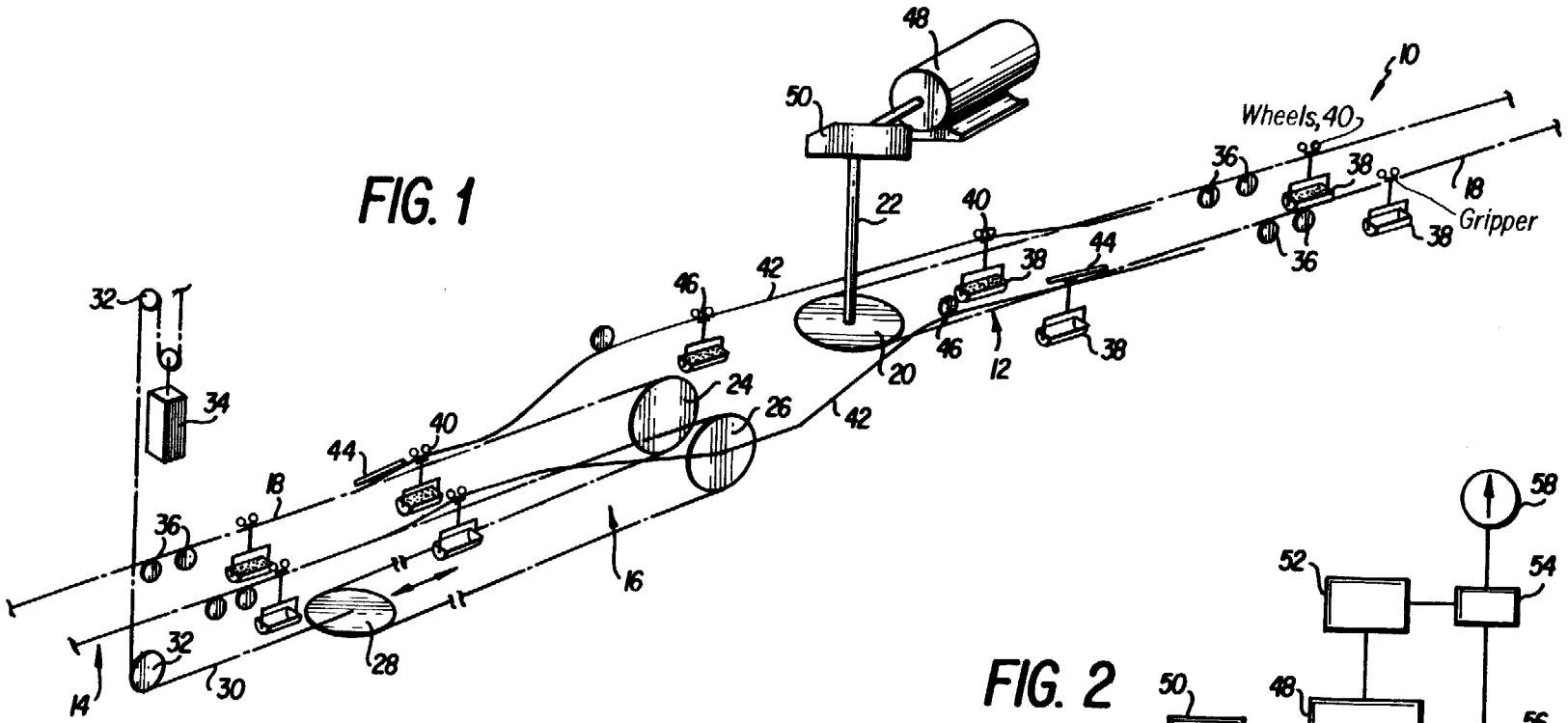
FIG. 1 is a fragmentary diagrammatic perspective view of a conveyer in accordance with the invention.
Figure 2:
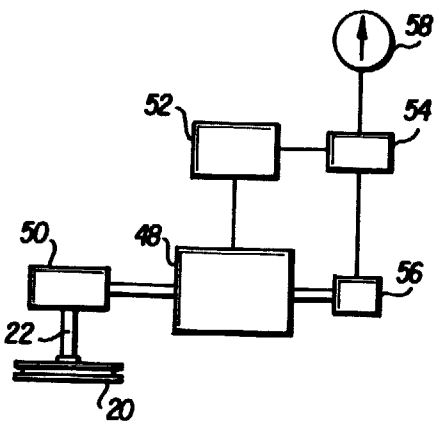
FIG. 2 is a schematic view showing a detail of FIG. 1.

FIG. 1 shows the arrival station 12 of a section 10 of a conveyer apparatus and the starting station 16 of the following section 14. The starting station of section 10 which is not shown is identical to the starting station 16 of section 14 and the arrival station of section 14 which also is not shown is identical to the arrival station of section 10. The conveyer comprises a plurality of successive sections for conveying materials over long distances, for instance of more than ten kilometers. Materials are loaded at the starting station of the first section and unloaded at the arrival station of the last section. At intermediate points along the conveyer and between two successive sections materials may be stocked. As all the starting sections of the conveyers, as well as all the arrival stations, are identical, only the stations 16 and 12 shown in FIG. 1 are now described.

The embodiment of the invention shown in FIG. 1 is an aerial cableway conveyer system having a single cable 18 which extends between the starting station and the arrival station and is moved in an endless path having two parallel runs for respectively supporting the loaded and empty conveyer elements. The cable 18 passes in the arrival station 12 over a terminal return sheave 20 having a vertical shaft. In the starting station 16 the cable 18 is guided into and away from a return sheave 28 by means of guide sheaves 24, 26. The return sheave 28 is mounted on a carriage (not shown) for reciprocating movement toward and away from the guide sheaves 24, 26. A cable 30 is connected at one end to the carriage, guided around pulleys 32 and connected at its opposite end to a counterweight 34 to maintain tension on the cable 18 despite variations in load. For driving the conveyer, the guide sheave 26 is driven by an electrical motor (not shown). Rotatable cable guide wheels 36, are supported on towers (not shown) and support or hold down the cable 18.

The conveyer units or carriers 38 have grips to connect the carriers on the towing cable 18 and wheels 40 which run in the stations upon transfer or shunt rails 42 to take up the carrier and to break the connection to the towing cable. In the starting station 26 a loaded carrier 38 is connected to the cable 18 and when the carrier arrives at the other station at which is provided a transfer rail 42 the wheels 40 run up the upwardly inclined transfer rail to raise the grip and to break the connection to the towing cable. The transfer rails 42 extend between the arrival station 12 of one section 10 and the starting station 16 of the successive section to transfer the carriers 38 from one section to the other. The transfer rail 42 is constructed to uncouple and to decelerate the carrier 38, to guide the carrier by running by gravity towards the following section and to accelerate and to connect again the carrier to the towing cable of the following section. A sychronization friction wheel or endless band 44 is provided at the end portion of the transfer rail 42 for synchronizing the speed of the carrier and the speed of the cable. At the entrance of the end portion of the transfer rail a clock mechanism 46 will control the passage of the carriers to provide uniform spacing.

Such conveyers are well known.

In accordance with the present invention, the shaft 22 of the return sheave 20 is rotatably secured to a gear box 50, which is in turn rotatably secured to an electric rotating machine 48. The rotating machine 48 works as a motor or as a brake and is electrically connected to a power supply unit 52 connected to a control device 54 having two inputs, one receiving an input signal from a tachometer 56, for instance a tacho-generator driven by the machine 48, and the other receiving a signal from a speed selector switch 58. The electric machine 48 is advantageously a direct current machine having an armature winding supplied by a thyristor bridge. The position of the speed selector switch 58 corresponds to the speed of the cable drive motor in the starting station 16 and the control device 54 compares the two signals and transmits an output signal to the power supply unit 52 resulting from the difference between them.

When the speed of the return sheave 20 is lower than the speed indicated by the selector switch 58, the control device 54 applies to the bridge thyristors of the supply unit 52 turn on and turn off signals in such a sequence that the rotating machine 48 works as a motor for driving the cable. The additional drive power is maintained as long as the control device 54 measures a difference between the return sheave speed and the speed set value. When the speed of the return sheave 20 is too high, the control device 54 controls the supply unit 52 so that the rotating machine 48 works as a braking generator, to brake the cable speed. It is easy to see that this device stabilizes the speed of the return sheave 20 and thus the speed of the cable 18 at the end of the section. Thereby, the speed of the carriers 38 arriving at the arrival station and running into the transfer rail 42 is always the same. Further, the oscillations of the cable 18 along the line are reduced.

During starting or stopping of the conveyer, the set value of the speed selector switch 58 must correspond to the instantaneous value of the speed in the driving station for avoiding an overloading of the rotating machine 48. The set value may be adjusted automatically or, preferably, manually in accordance with a given time chart.

This speed control system works without any electrical connection between the starting station and the arrival station of the conveyer. The system may be applied to a conveyer for materials or passengers which only has one section, for instance, to chairlifts or gondolalifts. The drive station may be the arrival station and the conveyer may have two cables, a load support cable and a towing cable.

I claim:

1. An aerial cableway comprising:

a towing cable transporting a plurality of load carriers along an endless conveying run which extends between a driving station and a return station;

a cable drive sheave drivingly coupled to said cable and located in said driving station;

a cable return sheave drivingly coupled to said cable and located in said return station;

grips for coupling said load carriers to said towing cable and uncoupling said load carriers from the towing cable at the stations;

transfer rails in said statons for receiving and transfering the uncoupled load carriers;

a stabilization device for stabilizing the speed of rotation of said return sheave, said stabilization device comprising, an electric machine mechanically connected to said return sheave for driving and braking the return sheave, a power supply unit to power said electric machine, tachometer means for producing a first electric signal corresponding to the speed of the return sheave, speed selector means for producing a second electric signal corresponding to a selected speed, a control unit for controlling said electric machine, and receiving said first and second electric signals and producing an electric output signal when said first and second electric signals are not equal, said output signal being applied to said power supply unit for controlling said electric machine so as to brake the return sheave when said first signal is greater then said second signal and to drive the return sheave when said second signal is greater than said first signal.

2. An aerial cableway comprising:

a towing cable transporting a plurality of load carriers along an endless conveying run which extends between a driving station and a return station;

a cable drive sheave drivingly coupled to said cable and located in said driving station;

a cable return sheave drivingly coupled to said cable and located in said return station;

a plurality of grips for coupling said load carriers to said towing cable and uncoupling said load carriers from the towing cable at the stations;

a plurality of transfer rails in said stations for receiving and transferring the uncoupled load carriers;

a stabilization device for stabilizing the speed of rotation of said return sheave, said stabilization device comprising, an electric machine mechanically connected to said return sheave for driving and braking the return sheave, a power supply unit to power said electric machine, tachometer means for producing a first electric signal corresponding to the speed of the return sheave, speed selector means for producing a second electric speed corresponding to a selected speed, a control unit for controlling said electric machine, and receiving said first and second electric signals and producing an electric output signal when said first and second electric signals are not equal, said output signal being applied to said power supply unit for controlling said electric machine so as to brake the return sheave when said first signal is greater than said second signal and to drive the return sheave when said second signal is greater; and a plurality of successive conveyor sections, each comprising a towing cable passing in the return station on the return sheave coupled to a stabilization device and transfer rails which extend between successive sections to transfer the load carriers from the towing cable of one section to the successive towing cable of the successive section, said load carriers on said transfer rail being moved by their own momentum.

* * * * *